United States Patent [19]

Minami

[11] Patent Number: 4,546,687

[45] Date of Patent: Oct. 15, 1985

[54] MUSICAL PERFORMANCE UNIT

[76] Inventor: Eiji Minami, 23-2, Higashinakaburi 1-chome, Hirakata-shi, Osaka-fu, Japan

[21] Appl. No.: 555,004

[22] Filed: Nov. 21, 1983

[30] Foreign Application Priority Data

Nov. 26, 1982 [JP] Japan ..... 57-207814

[51] Int. Cl.[4] ..... G10H 3/08; G10H 3/09

[52] U.S. Cl. ..... 84/1.28; 84/477 R; 84/DIG. 29

[58] Field of Search ..... 84'/1.28, 454, 470 R, 84'/477 R, DIG. 29

[56] References Cited

U.S. PATENT DOCUMENTS

| | | | |
|---|---|---|---|
| 3,539,701 | 11/1970 | Milde | 84/1.28 |
| 3,634,596 | 1/1972 | Rupert | 84/1.28 |
| 3,919,913 | 11/1975 | Shrader | 84/454 |
| 4,182,214 | 1/1980 | Wakeman | 84/1.28 |

OTHER PUBLICATIONS

25, *Journal of the Patent Office Society*, 904, Ex parte S, (Board of Appeals), Aug. 4, 1943, (Case No. 109).

*Primary Examiner*—S. J. Witkowski

[57] ABSTRACT

A musical performance or accompaniment unit which is so arranged that, with employment of a so-called sound multiplex system recording medium in which a vocal signal of a singer or the like is recorded on its first track and a musical signal of a musical instrument for accompaniment is recorded on its second track, when a user sings, with the recording medium being subjected to reproduction, singing abilities of the user such as rhythmical feelings, degrees of bass or soprano, etc. are automatically marked for display through comparison and calculation of the above reproduced vocal signal and signal of the song sung by the user.

2 Claims, 6 Drawing Figures

MUSICAL PERFORMANCE UNIT

BACKGROUND OF THE INVENTION

The present invention generally relates to an acoustic appliance and more particularly, to a musical accompaniment unit which is so arranged that, with employment of a so-called sound multiplex system recording medium in which a vocal signal of a singer or the like is recorded on its first track and a musical signal of a musical instrument for accompaniment is recorded on its second track, when a user sings, with the recording medium being subjected to reproduction, singing abilities of the user such as rhythmical feelings, degrees of bass or soprano, etc. are automatically marked for display through comparison and calculation of the above reproduced vocal signal and signal of the song sung by the user.

In one field of acoustic appliances, there has been provided a unit which is arranged to reproduce and amplify a signal of a musical instrument or the like recorded for accompaniment on a recording medium, so that when a user sings a song to the reproduced musical signal, the song is amplified simultaneously with such musical signal. The unit as described above is commonly called "a musical accompaniment unit", and has come into wide application for general home use and business use. Subsequently, such a musical accompaniment unit will be referred to as a musical performance unit hereinafter.

In one type of the recent musical performance units, there is proposed a musical performance unit equipped with a marking or rating device capable of automatically displaying abilities for expressions or singing when a user sings a song to a reproduction of a particular recording medium.

Hereinbelow, one example of a conventional musical performance unit with a marking device will be described with reference to FIG. 1 showing a fragmentary top plan view of a conventional recording medium, and FIG. 2 illustrating a construction of the conventional musical performance unit.

In FIG. 1, the recording medium 1, for which a magnetic tape is employed in many cases, has a first track 1*a* in which a signal of a musical instrument, a pulse signal equivalent to a musical note serving as a standard for the marking or the like is recorded, and a second track 1*b* in which a musical signal by a common musical instrument is recorded. Meanwhile, as shown in FIG. 2, the known musical performance unit includes a first reproducing means 2 constituted, for example, by a magnetic head 21 and an amplifier 22 for reproducing the signal recorded on the first track 1*a*, a second reproducing means 3 constituted, for example, by a magnetic head 31 and an amplifier 32 for reproducing the signal recorded on the second track 1*b*, a first amplifying means 4 constituted by a microphone 41 and an amplifier 42, and a computer 7 coupled to the first reproducing means 2, to the second reproducing means 3 through a second amplifying means 5 connected to a loud speaker 6, to the first amplifying means 4, and also to a display means 8. The second amplifying means 5 is arranged to mix the output of the second reproducing means 3 with that of the first amplifying means 4 for amplification so as to drive the loud speaker 6, while the computer 7 is adapted to drive the display means 8 through calculation and comparison between the output of the first reproducing means 2 and that of the first amplifying means 4.

Subsequently, functionings of the conventional musical performance unit equipped with the marking device having the construction as described above will be described hereinbelow.

In the first place, on the assumption that the magnetic heads 21 and 31 are respectively held in contact with the first track 1*a* and the second track 1*b* upon starting of the recording medium 1 for running or rotation, the musical signal recorded on the second track 1*b* is converted into an electric signal by the magnetic head 31 so as to be amplified by the amplifier 32 for being supplied to the second amplifying means 5, which drives the loud speaker 6. Consequently, the musical signal recorded on the second track 1*b* is amplified and converted into sound waves by the loud speaker 6. When a user sings to the music from the loud speaker 6 over the microphone 41, the output of the microphone 41 is amplified by the amplifier 42 so as to be supplied to the second amplifying means 5. As a result, mixed sound waves of the musical signal recorded on the first track 1*b* and the signal of the microphone 41 as amplified are produced from the loud speaker 6, and thus, the user may obtain feelings of pleasure or satisfaction by singing a song in such a manner. Meanwhile, to the computer 7, the signal serving as the standard for the markings and recorded on the first track 1*a* is supplied through the magnetic head 21 and the amplifier 22, together with the output of the first amplifying means 4, and these signals are subjected to the calculation processing in the digital form for display of the result of markings by the display means 8. Accordingly, levels of skillfulness for the song sung by the user may be readily found for improvements through exercises or for utilization as a game.

The conventional arrangement as described above, however, has such a disadvantage that a special recording medium must be employed for the recording medium 1. More specifically, the first track 1*a* of the recording medium 1 is required to be recorded with the signal or pulse signal, etc. corresponding to the musical note serving as the standard of the markings, and can not be readily prepared as desired by users in general. Moreover, in the case where a common recording medium available in the market is employed, the marking function can not be actuated. Furthermore, the user can not understand how he should sing a song in order to obtain a good marking unless the song is repeatedly sung many times.

SUMMARY OF THE INVENTION

Accordingly, an essential object of the present invention is to provide a musical performance unit capable of marking or rating a rhythmical feeling which is one of factors of singing abilities of a user through employment of a sound multiplex system recording medium commercially available in general for the user to obtain easily.

Another important object of the present invention is to provide a musical performance unit of the above described type which is simple in construction and stable in functioning at high reliability.

It should be noted here that the sound multiplex system recording medium referred to above is a recording medium in which a vocal signal of a singer or the like is recorded on its first track, while a musical signal is recorded on its second track, and which has rapidly spread recently for wide applications, since it is most suitable for exercises of singing songs.

In accomplishing these and other objects, according to one preferred embodiment of the present invention, there is provided a musical performance unit which employs a sound multiplex system recording medium including a first track on which a vocal signal is recorded and a second track on which a musical signal is recorded. The musical performance unit includes a first reproducing means for reproducing the vocal signal on the first track of the sound multiplex system recording medium, a second reproducing means for reproducing the musical signal on the second track of said sound multiplex system recording medium, a first amplifying means for amplifying a signal for a microphone, a first waveform converting means for producing a pulse signal having a time width corresponding to a period of the output of said first reproducing means, a second waveform converting means for producing a pulse signal having a time width corresponding to a period of the output of said first amplifying means, a calculating means for calculating information based on a relative time width variation of the outputs of said first waveform converting means and said second waveform converting means, and a display means for displaying an output of said calculating means. The vocal signal recorded on the first track of the sound multiplex recording medium and the signal of the microphone are subjected to comparative processing by the calculating means in the digital form so as to display skillfulness of a song sung by a user or markings corresponding thereto.

By the arrangement of the present invention as described above, an improved musical performance unit has been advantageously presented, with a substantial elimination of disadvantages inherent in the conventional arrangements of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
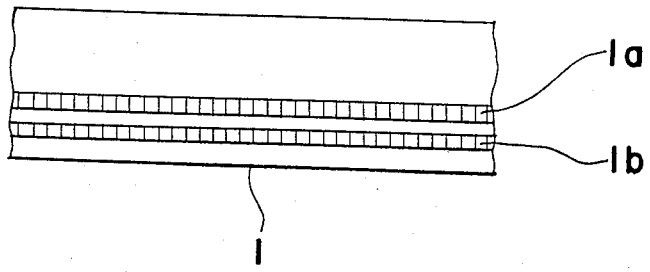
Fig. 1 PRIOR ART
FIG. 1 is a fragmentary top plan view of a recording medium for use in a conventional musical performance with a marking device.

Before the description of the present invention proceeds, it is to be noted that like parts are designated by like reference numerals throughout the accompanying drawings.

Figure 2:
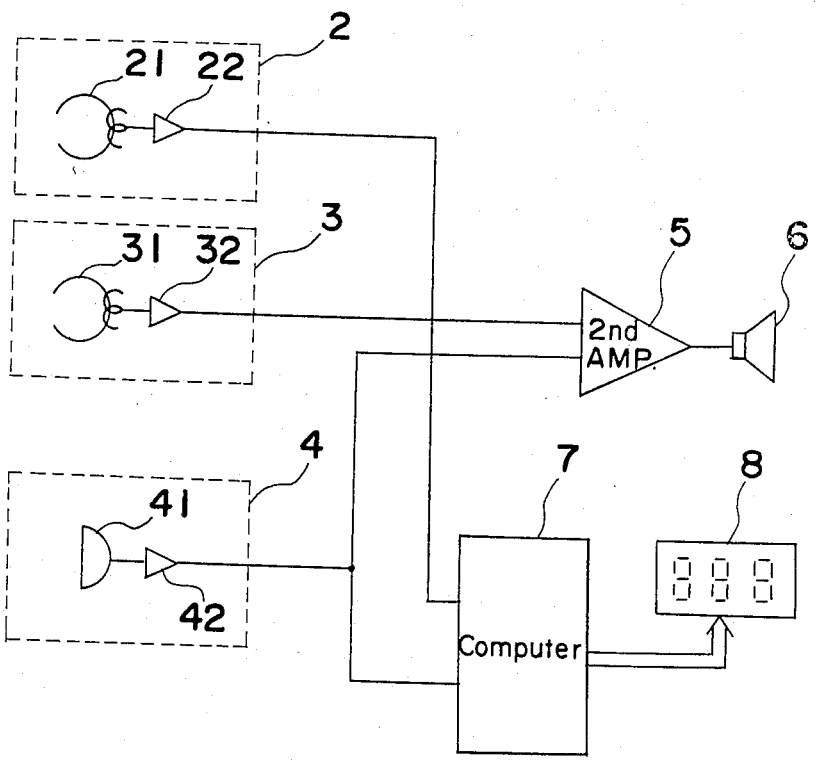
Fig. 2 PRIOR ART
FIG. 2 is an electric block diagram showing a construction of the conventional musical performance unit equipped with the marking device.
Figure 3:
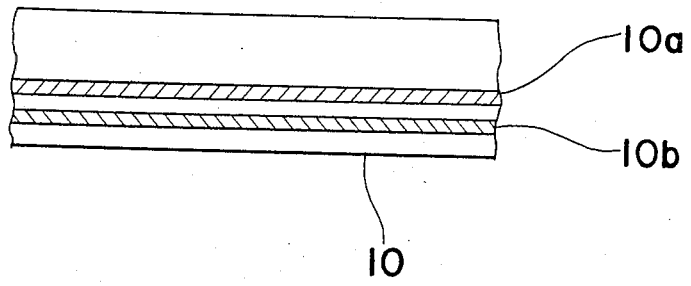
FIG. 3 is a fragmentary top plan view of a sound multiplex system recording medium which may be employed for a musical performance unit of the present invention.
Figure 4:
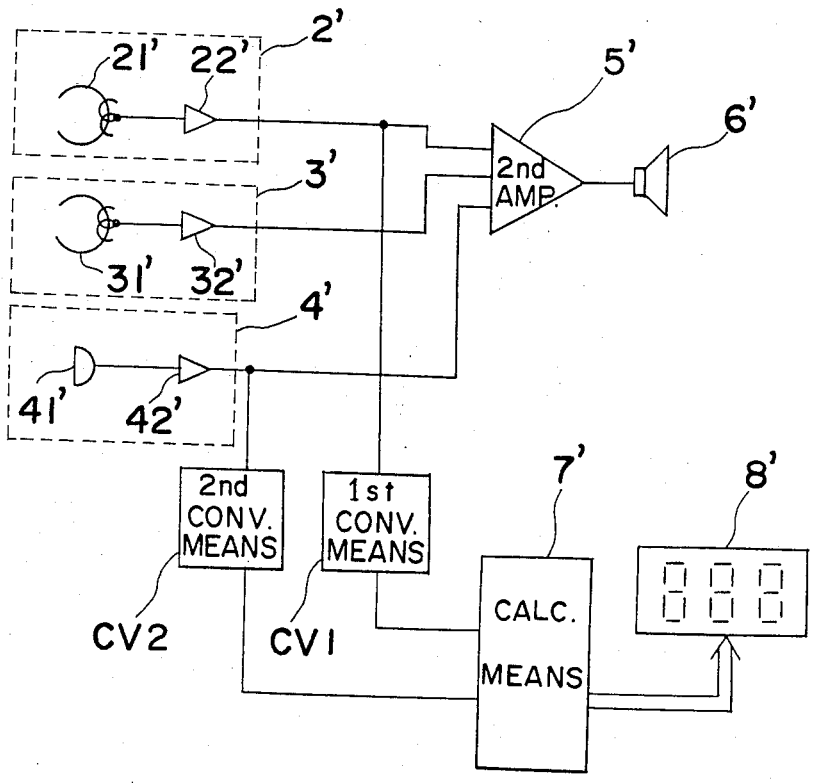
FIG. 4 is an electric block diagram showing a construction of the musical performance unit according to one preferred embodiment of the present invention.

Referring now to the drawings, FIG. 3 shows a fragmentary top plan view of a commercially available sound multiplex system recording medium 10 which may be employed for a musical performance unit of the present invention, and which includes a first track 10*a* and a second track 10*b*, while in FIG. 4, there is shown an electrical block diagram illustrating the general construction of the musical performance unit according to one preferred embodiment of the present invention, in which like parts in FIG. 2 are designated by like reference numerals. The musical performance unit of FIG. 4 includes a first reproducing means 2', a second reproducing means 3' and a first amplifying means 4', which are connected to a second amplifying means 5' coupled to a loud speaker 6', a calculating or operating means 7', which is connected to the first reproducing means 2' and the first amplifying means 4', respectively, through a first converting means CV1 and a second converting means CV2 and also connected to the display means 8'.

The first reproducing means 2' is constituted by a magnetic head 21' and an amplifier 22' when a magnetic tape or magnetic sheet is employed as a sound multiplex system recording medium 10. Similarly, the second reproducing means 3' is constituted by a magnetic head 31' and an amplifier 32', while the first amplifying means 4' is constituted by a microphone 41' and an amplifier 42'. The second amplifying means 5' may be constituted by an ordinary power amplifier. The first converting means CV1 and the second converting means CV2 are constituted by ordinary Schmidt circuits, diode limiter circuits, etc. The calculating means 7' may be constituted, for example, by a micro-computer. Meanwhile, the display means 8' is constituted by light emitting diodes, fluorescent display tubes, liquid crystals, etc.

The musical performance unit according to one preferred embodiment of the present invention and having the construction as described so far, functions in a manner as described hereinbelow.

It is assumed here that the sound multiplex system recording medium 10 is running or rotating, with the magnetic head 21' and the magnetic head 31' being respectively held in contact with the first track 10*a* and the second track 10*b*. The vocal signal of a singer or the like recorded on the first track 10*a* is converted into an electrical signal by the magnetic head 21' and amplified by the amplifier 22' so as to be fed to the second amplifying means 5'. Meanwhile, the musical signal recorded on the second track 10*b* is converted into an electrical signal by the magnetic head 31' and amplified by the amplifier 32' so as to be supplied to the second amplifying means 5', which amplifies the outputs of the first reproducing means 2' and the second reproducing means 3' for driving the loud speaker 6'. The user sings a song over the microphone 41', while listening to the musical and vocal sound waves produced from the loud speaker 6'. The signal output from the microphone 41' is amplified by the amplifier 42' and fed to the second amplifying means 5'. As a result, amplified sounds in which the vocal signal of the first track 10*a*, the musical signal of the second track 10*b* and the song sung by the user are mixed, are produced from the loud speaker 6'. In the above case, if it is so arranged that the loudness of these sounds may be independently adjusted respectively at the second amplifying means 5', the degree of loudness of the vocal signal of a singer or the like recorded on the first track 10*a* to be produced from the loud speaker 6' can be varied as desired to suit to the progress in singing by the user for a sufficient exercise. When the user has mastered a song, it is possible to render the vocal signal of the first track 10*a* not to be produced from the loud speaker 6′ at all. In the manner as described above, the user may sufficiently practice the singing, and simultaneously acquire pleasure and joy in the singing.

Subsequently, the marking or rating functions of the musical performance unit of the present invention will be described hereinbelow.

In FIG. 4, the first converting means CV1 is arranged to produce a pulse signal having a time width corresponding to a period of the output of the first reproducing means 2′, and is constituted, for example, by a Schmidt circuit or limiter circuit. Similarly, the second converting means CV2 is adapted to generate a pulse signal having a time width corresponding to a period of the output of the first amplifying means 4′, and is also constituted by a Schmidt circuit or limiter circuit. The outputs of the first converting means CV1 and the second converting means CV2 are subjected to calculation in the digital form by the calculating means 7′, with the results thereby being displayed by the display means 8′. More specifically, the marking functions of the musical performance unit of the present invention is characterized in that the vocal signal of a singer or the like recorded on the first track 10*a* and the singing voice of the user are respectively converted into pulse signals, and these signals are subjected to the comparative calculation in the digital form by the calculating means 7′. Therefore, the user is fully informed of the marking standard, and clearly understands how he should sing for progress.

Figure 5:
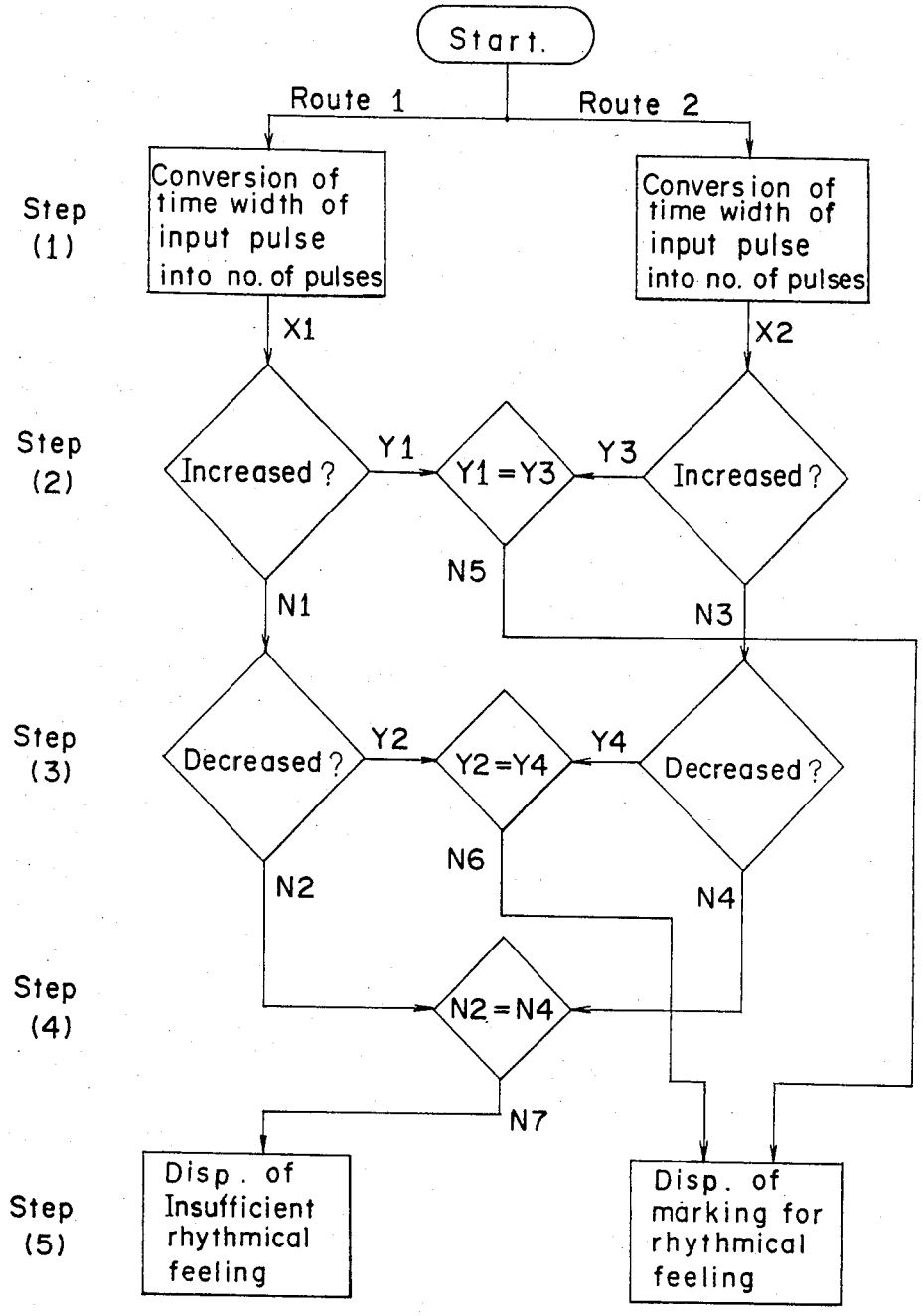
FIG. 5 is a flowchart for explaining functionings of the musical performance unit of FIG. 4.
Figure 6:
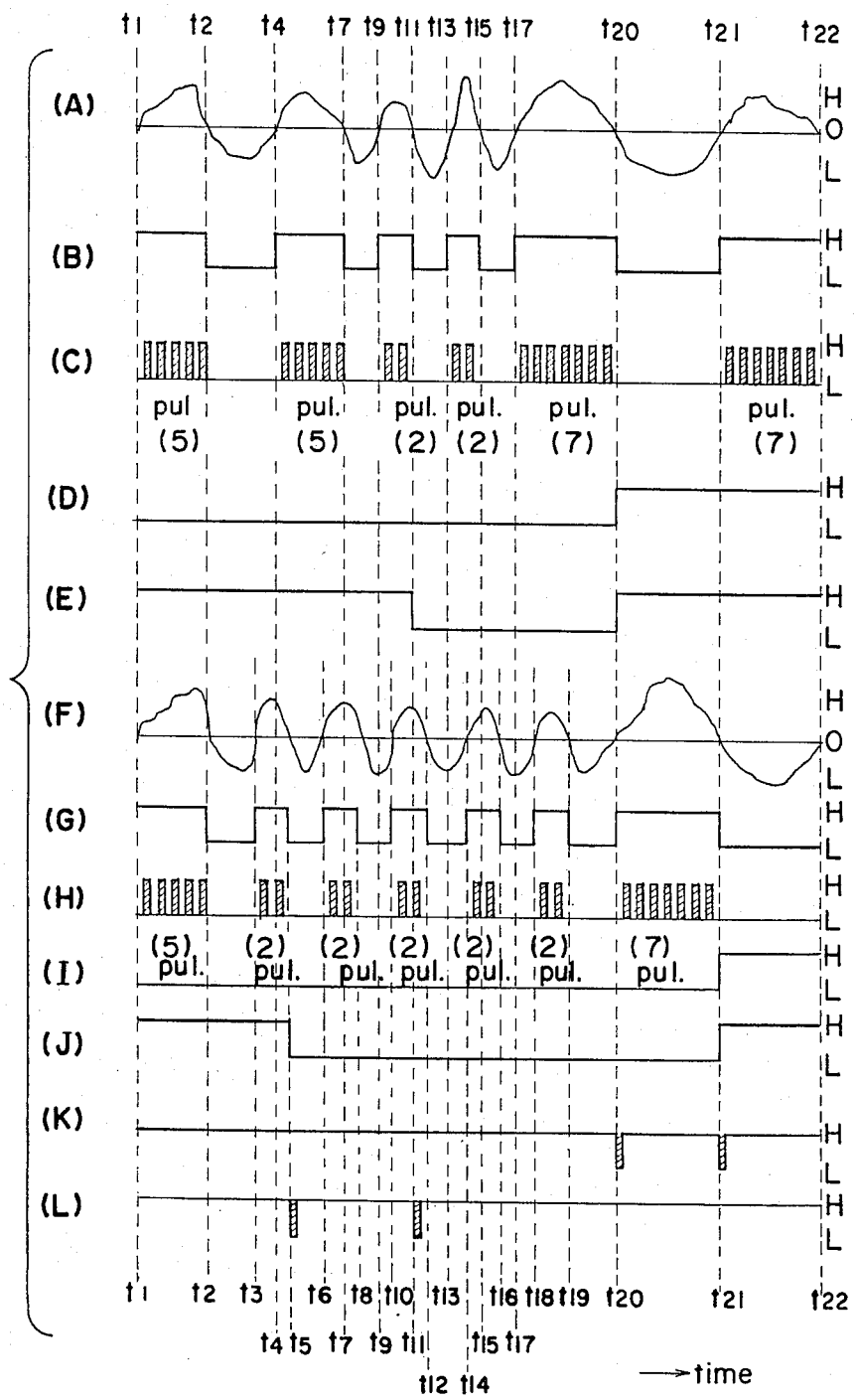
FIG. 6 is a timing chart also for explaining functionings of the musical performance unit of FIG. 4.

Referring also to FIG. 5 showing a flow-chart for the functions in the musical performance unit according to one preferred embodiment of the present invention and FIG. 6 showing a timing chart thereof, the marking functions referred to above will be described in more detail hereinbelow, with FIG. 5 being associated with FIG. 6 for the explanation.

In FIG. 6(A), there is shown the output of the first reproducing means 2′, i.e., the reproduction waveform of the vocal signal of a singer or the like recorded on the first track 10*a*, while FIG. 6(B) shows the output waveform of the first converting means CV1, and it is so arranged that, during the period where the waveform of FIG. 6(A) is in a positive voltage level (referred to as an H level hereinafter), the waveform in FIG. 6(B) is also in the H level. FIG. 6(F) shows the output waveform of the first amplifying means 4′, i.e., variation with time of the song sung by the user. Meanwhile, FIG. 6(G) represents the output of the second converting means CV2, and the arrangement is so made that during the period in which the waveform of FIG. 6(F) is in the H level, the waveform of FIG. 6(G) also becomes the H level.

Subsequently, the reason for producing the pulse signals in the first converting means CV1 and the second converting means CV2 will be explained hereinbelow.

In the vocal signal of a singer recorded on the first track 10*a*, the variation with time of the waveform as in FIG. 6(A) differs depending on whether the song is sung by a male singer or a female singer, or according to a personality, abilities for expressions and singing, etc. of the individual singers. Moreover, in the case where the user has sung a song, the waveform in FIG. 6(F) may differ depending on the skillfulness for singing, whether the user is male or female, or according to the user's singing abilities, way of singing the song with his or her own melody or tune, etc. When such conditions are taken into account, it is difficult to directly compare the waveform of FIG. 6(A) with that of FIG. 6(F), and the simplest method will be to effect the calculation processing after conversion thereof into pulse waveforms. Moreover, it should be so arranged that the musical factors largely affected by individual differences, for example, difference in a musical interval (also represented by a term "keynote") which can be uttered by the user, presence or absence of the singer's own melody or tune during the singing of the song, etc., do not give influence over the marking functions.

Hereinbelow, functions of the calculating means will be explained.

The output pulse of the first converting means CV1 is processed by the calculating means 7′ according to the flow of a route (1) shown in FIG. 5. Meanwhile, the output pulse of the second converting means CV2 is similarly processed by the calculating means 7′ according to the flow of a route (2) illustrated in FIG. 5. In the first place, at a step (1) of FIG. 5, the time width of the input pulse is substituted for or converted into the number of pulses. In other words, it is calculated how many pulses of a predetermined period (referred to as clock pulses hereinbelow) are accommodated in the H level period of the waveform of FIG. 6(B). The number of pulses X1 is represented as in FIG. 6(C). Moreover, it is also calculated how many clock pulses are accommodated in the H level period of the waveform of FIG. 6(G), and the number of pulses X2 is shown as in FIG. 6(H). Accordingly, the number of pulses X1 in FIG. 6(C) corresponds to the length of the H level period of the waveform of FIG. 6(A), while the number of pulses X2 in FIG. 6(H) corresponds to the length of the H level period of the waveform of FIG. 6(F), and it is assumed that the variations from the time t1 to t21 are respectively as shown in FIG. 6.

Next, description will be made on step (2) in FIG. 5.

In route (1), judgement is made as to whether or not the number of pulses is increased, and when the number of pulses has increased more than that in the previous state, an output Y1 is produced. More specifically, upon variation of the number of pulses X1 as shown in FIG. 6(C), the output Y1, i.e., the waveform of FIG. 6(D) becomes the H level at the time t20, and since the number of pulses X1 from the time t17 to the time t20 is seven pulses while that from the time t20 to the time t22 is also seven pulses without any change, the Y1 output, i.e., the waveform of FIG. 6(D) remains in the H level from the time t20 to the time t22. On the other hand, in route (2) in FIG. 5, judgement is made as to whether or not the number of pulses X2 has increased, and if it has increased, an output Y3 is produced. In other words, the output of the H level as shown in the waveform of FIG. 6(I) is produced at the time t21 when the number of pulses X2 in FIG. 6(H) has increased, with this H level being maintained up to the time t22. Incidentally, in step (2) of FIG. 5, comparison is made between the Y1 output and the Y3 output, and if they are not equal to each other, an output N5 is produced. More specifically, pulses are produced at the time t20 and the time t21 as shown in FIG. 6(K). This is attributable to the fact that, at the time t20, the waveform of FIG. 6(I) is in the L level irrespective of variation of the waveform in FIG. 6(D) from the L level to the H level, and also that, at the time t21, the waveform of FIG. 6(I) is changed to the H level, irrespective of the waveform of FIG. 6(D) being maintained at the H level. The pulses N5 at the time t20 and the time t21 in the waveform of FIG. 6(K) have a meaning as follows. In other words, they mean that the variation of the waveform of FIG. 6(I) is delayed from the time t20 to the time t21 with respect to the variation of the waveform in FIG. 6(D). More specifically, if explained with reference to FIGS. 3 and 4 also, such pulses N5 mean that, in spite of the fact that the frequency or tone of the vocal signal of a singer or the like recorded on the first track 10*a* becomes low from the time t20 as in the waveform of FIG. 6(K), the frequency or tone of the song sung by the singer is lowered from the time t21, and thus, there is the time delay by that extent, with a consequent poor rhythmical feeling. Accordingly, the result of the marking becomes worse as the number of pulses N5 in the waveform of FIG. 6(K) increases.

Subsequently, a step (3) in FIG. 5 will be described hereinbelow.

In route (1), when the number of pulses X1 is not increased, the steps are shifted from step (2) to a step (3) for judgement as to whether or not the number of pulses X2 is reduced, and if the number of pulses X2 has been reduced, an output Y2 is produced. In other words, if the number of pulses X1 in FIG. 6(C) is reduced at the time t11 (from five pulses to two pulses), the variation from the H level to the L level takes place as in the waveform of FIG. 6(E), and upon comparison of the number of pulses of the waveform in FIG. 6(C) between the period from the time t13 to the time t15 and the period between the time t17 and the time t20, the number of pulses increases from two to seven pulses, and therefore, the waveform of FIG. 6(E) returns to the original H level at the time t20. Meanwhile, at step (3) in route (2) of FIG. 5, judgement is made as to whether or not the number of pulses is reduced, and if it has been decreased, an output Y4 is produced. More specifically, when explained with reference to FIG. 6, the above function is as follows. Owing to the fact that the number of pulses of the waveform of FIG. 6(H) is five pulses from the time t1 to the time t2, two pulses from the time t3 to the time t5, and thereafter, seven pulses from the time t20 to the time t21 without any alteration, the output Y4 is changed into the L level at the time t5 and returns back to the original H level at the time t21 as shown in the waveform of FIG. 6(J), and at this step (3), the outputs Y2 and Y4 are compared with each other as in FIG. 5 for judgement as to whether or not they are equal to each other. If they are not equal to each other, an output N6 is produced. The state of the above function will be described with reference to the waveform of FIG. 6. In the first place, it is to be noted that the output Y2 corresponds to the waveform in FIG. 6(E), and the output Y4 to the waveform of FIG. 6(J). At the time t5, the waveform of FIG. 6(E) is at the H level in spite of the fact that the waveform of FIG. 6(J) has been changed into the L level, and therefore, a pulse is produced for the output N6 as shown in a waveform of FIG. 6(L). Meanwhile, at the time t11, since the waveform of FIG. 6(J) is maintained at the L level in spite of the fact that the waveform of FIG. 6(E) has changed from the H level to the L level, a pulse is produced as in the waveform of FIG. 6(L). The waveform of FIG. 6(L) is arranged not to produce pulses even when the waveform of FIG. 6(E) is changed from the L level to the H level at the time t20, and the waveform of FIG. 6(J) is changed from the L level to the H level at the time t21.

What is meant by the pulses N6 in the waveform of FIG. 6(L) is such that, the frequency or period for the waveform of FIG. 6(F) has become high at the time t3 so as to be in a state advancing too much in spite of the fact that the frequency or period for the waveform of FIG. 6(A) becomes high from the time t9, and more specifically, that the frequency or period for the singing voice of the user is in a state faster and higher in terms of time than that of the vocal signal of the singer or the like recorded on the first track 10*a*. In connection with the above, the result of the marking becomes worse as the number of pulses in the waveform of FIG. 6(L) increases.

For judging whether or not the song sung by the user is leading or lagging behind the vocal signal of a singer or the like, there may be employed a practice as follows. By way of example, in the case where the waveform of FIG. 6(D) is changed from the L level to the H level, the pulse width of the waveform of FIG. 6(K) is arranged to be different, in the time width, from the pulse width of the waveform of FIG. 6(K) produced when the waveform of FIG. 6(I) is altered from the L level to the H level. By the above arrangement, it may be judged whether or not the song sung by the user is lagging behind the vocal signal through the difference in the pulse widths in the waveform of FIG. 6(K), produced at the time t20 and the time t21. Similarly, in a waveform of FIG. 6(L) also, if a difference is provided between the time widths of pulses produced at the time t5 and the time t11, judgement as to whether or not the song sung by the user is leading the vocal signal may be effected.

Subsequently, description will be made on a step (4) of FIG. 5. In the case where there is no change in the number of pulses X1 for route (1), an output N2 is produced, while, in route (2), if there is no change in the number of pulses X2, an output N4 is produced. Thus, when output N2 is equal to output N4, no output is produced, but if it is not equal to output N4, there is produced an output N7, which corresponds to the case where the song sung by the user has no rhythmical feeling, with less variation in the tone.

Hereinbelow, a step (5) in FIG. 5 will be explained. Step (5) is the step for effecting the display, and in the course of singing, the output N7 is displayed by the display means 8'. In other words, a warning is given to the user that the rhythmical feeling which is one of the factors of a song, is insufficient. Although not particularly shown in FIG. 5, it is also possible to draw the user's attention by displaying the lead or lagging in the timing of singing by the display means 8' through detection of differences in the time widths of the respective pulses for the waveforms of FIGS. 6(K) and 6(L).

Upon completion of singing a song, the outputs from the first reproducing means 2' and the second reproducing means 3' are suspended, and when instruction pulses (not shown) are fed to the calculating means 7' through detection of the above state, the calculating means 7' calculates the total number of pulses of the outputs N5 and N6 of FIG. 5 so as to add weight thereto for subtraction from a full mark of 100 points, and thus, the result of the marking for the rhythmical feeling may be displayed. For example, if it is assumed that the number of pulses the output N5 is 40 pulses, and that for the output N6 is 20 pulses, with the coefficient for the weighting set to be 0.5, the result will be, $$M = 100 - 0.5(40 + 20) = 70$$

where M is the points for the rhythmical feeling, and thus, the marking of 70 points can be displayed on the display means 8'.

Furthermore, it is also possible to effect other kinds of displays depending on necessity.

For example, although not shown in FIG. 5, it may be so arranged that, with the number of pulses for the waveforms of FIGS. 6(D), 6(E), 6(I) and 6(J) preliminarily memorized, the total numbers for the respective pulses are calculated for comparison of the numbers of pulses in the waveforms of FIGS. 6(D) and 6(I), and if the waveform of FIG. 6(I) has more pulses, it is displayed that the singing by the user has a sufficient bass sound, while, if the waveform of FIG. 6(E) has more pulses upon comparison of the number of pulses between the waveforms of FIGS. 6(E) and 6(J), it is indicated that the singing by the user is rather insufficient in the soprano sound.

Moreover, various variations and modifications are possible for other applications of the present invention. For example, if the user has sung only a first verse of a song including three verses, the value M for the marking of the rhythmical feeling up to that time may be corrected to $\frac{1}{3}$ for display. It is further possible to effect more modifications through combinations of the programs for the calculating means.

It should be noted here that, in the block diagram of FIG. 4 showing the construction of the musical performance unit according to one preferred embodiment of the present invention, although the second amplifying means 5' and the loud speaker 6' are described as included in the musical performance unit, an amplifying means and a loud speaker of another acoustic appliance (not particularly shown) may be utilized for the second amplifying means 5' and the loud speaker 6', with terminals for supplying signals thereto being provided in the musical performance unit.

As is clear from the foregoing description, according to the musical performance unit of the present invention, it is not necessary to employ a particular recording medium as in the conventional musical performance unit equipped with the marking device, and the commercially available sound multiplex system recording medium, which has rapidly spread recently, can be adopted for exercises of singing, while various factors of songs such as rhythmical feeling, etc. may be graded for markings.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A musical performance unit which employs a sound multiplex system recording medium including a first track on which a vocal signal is recorded and a second track on which a musical signal is recorded, said musical performance unit comprising:

a first reproducing means for reproducing the vocal signal on the first track of the sound multiplex system recording medium;

a second reproducing means for reproducing the musical signal on the second track of said sound multiplex system recording medium;

a first amplifying means for amplifying a signal from a microphone;

a first waveform converting means for producing a pulse signal having a pulse width corresponding to a period of the output of said first reproducing means;

a second waveform converting means for producing a pulse signal having a pulse width corresponding to a period of the output of said first amplifying means;

a calculating means for calculating information and providing an output corresponding thereto based on relative variations in the outputs of said first waveform converting means and said second wareform converting means, said calculating means comparing pulse signal envelopes of said two pulse signals so as to determine the degree of coincidence therebetween during a predetermined time period;

a display means for displaying said output of said calculating means, said vocal signal recorded on the first track of the sound multiplex recording medium and the signal of the microphone being subjected to comparative processing by said calculating means in a digital form so as to display skillfulness of a song sung by a user or markings corresponding thereto;

and a second amplifying means for mixing and amplifying the respective outputs of said first reproducing means, said second reproducing means, and said first amplifying means and for driving a loudspeaker.

2. A musical performance unit as in claim 1, wherein said calculating means compares pulse widths and repetition rates and the occurrance or absence of pulses of said two pulse signal to compare envelopes of said two pulse signals to determine the degree of coincidence therebetween.

* * * * *